US007452450B2

(12) United States Patent
Julsrud et al.

(10) Patent No.: US 7,452,450 B2
(45) Date of Patent: Nov. 18, 2008

(54) DIMENSIONALLY STABLE ANODE FOR THE ELECTROWINNING OF ALUMINUM

(75) Inventors: Stein Julsrud, Skien (NO); Turid Risdal, Porsgrunn (NO)

(73) Assignee: Norsk Hydro ASA, Oslo (NO)

( * ) Notice: Subject to any disclaimer, the term of this patent is extended or adjusted under 35 U.S.C. 154(b) by 302 days.

(21) Appl. No.: 10/493,661

(22) PCT Filed: Sep. 25, 2002

(86) PCT No.: PCT/NO02/00338

§ 371 (c)(1),
(2), (4) Date: Jun. 10, 2004

(87) PCT Pub. No.: WO03/035940

PCT Pub. Date: May 1, 2003

(65) Prior Publication Data

US 2004/0245096 A1 Dec. 9, 2004

(30) Foreign Application Priority Data

Oct. 25, 2001 (NO) ..... 20015205
Nov. 9, 2001 (NO) ..... 20015491

(51) Int. Cl.
*C25B 11/04* (2006.01)

(52) U.S. Cl. ..... 204/291; 204/290.01; 204/290.09; 204/290.12; 204/243.1

(58) Field of Classification Search ..... 204/291, 204/290.01, 290.09, 243.1, 290.12; 205/385, 205/387, 388
See application file for complete search history.

(56) References Cited

U.S. PATENT DOCUMENTS

| | | | | |
|---|---|---|---|---|
| 4,478,693 | A | 10/1984 | Ray | |
| 4,500,406 | A | 2/1985 | Weyand et al. | |
| 6,103,090 | A * | 8/2000 | de Nora et al. | 205/384 |
| 6,379,526 | B1 * | 4/2002 | de Nora et al. | 205/384 |
| 6,423,204 | B1 * | 7/2002 | Ray et al. | 205/387 |
| 2004/0094429 | A1 * | 5/2004 | Julsrud et al. | 205/387 |

FOREIGN PATENT DOCUMENTS

| | | |
|---|---|---|
| WO | 0131090 | 5/2001 |
| WO | 0131091 | 5/2001 |

* cited by examiner

*Primary Examiner*—Bruce F Bell
(74) *Attorney, Agent, or Firm*—Wenderoth, Lind & Ponack, L.L.P.

(57) ABSTRACT

An anode for the electrolysis of aluminium made from an outer dense layer of a ceramic material on a dense core made from a composite of the ceramic material of the outer layer and an electronic conductor.

7 Claims, 6 Drawing Sheets

DIMENSIONALLY STABLE ANODE FOR THE ELECTROWINNING OF ALUMINUM

FIELD OF INVENTION

Figure 1:
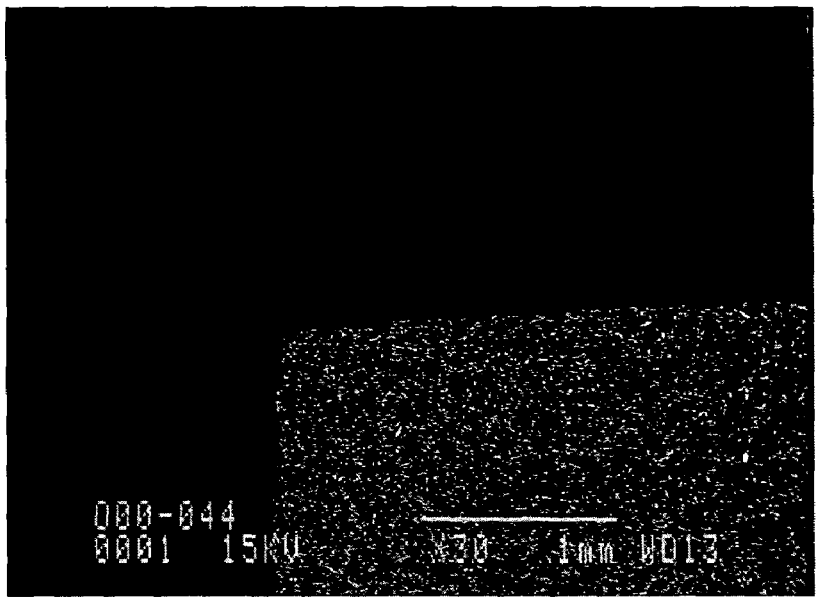

The present invention relates to the construction of an anode that can be used as an essentially inert anode for the electrowinning of aluminium.

BACKGROUND ART

Conventionally, aluminium is produced by electrolysis of alumina dissolved in a cryolite-based molten salt electrolyte by the more than a hundred years old Hall-Heroult process. In this process carbon electrodes are used, where the carbon anode is taking part in the cell reaction. This results in the simultaneous production of $CO_2$ and aluminium. The net consumption of the anode is 400-450 kg/ton of aluminium produced, causing emissions of greenhouse gases like $CO_2$ and fluorocarbon compounds. For both cost and environmental reasons the replacement of carbon anodes with an effectively inert material would be highly advantageous. The electrolysis cell would then produce oxygen and aluminium.

Such an anode will, however, be subject to extreme conditions, and will have to fulfill very strict requirements. The anode will simultaneously be subjected to around 1 bar of oxygen at high temperature, the very corrosive molten salt electrolyte specifically chosen to be a solvent for oxides and a high aluminium oxide activity. The corrosion rate must be low enough so that a reasonable time between anode changes is achievable. The corrosion products should not adversely affect the quality of the produced aluminium. The first criterion would mean a corrosion rate not larger than a few millimeters per year, while the second is very dependent on the elements involved, from as high as 2000 ppm for Fe to only a few tens of ppm or lower for elements like Sn to fulfill today's requirements for top quality commercial aluminium. The conditions make the range of materials that can be expected to fulfill the requirements very limited.

Many attempts have been made to develop anodes for this use. The work can be divided into three main approaches; a ceramic material doped to sufficient electronic conductivity, a two or more phase ceramic/metal composite or a metal alloy anode.

Many of the compounds that much work later have been focused on in the first group, were first studied in this context by Belyaev and Studentsov (Legkie Metally, 6, No. 3, 17-24 (1937)) a.o. $Fe_3O_4$, $SnO_2$, $CO_3O_4$ and NiO and Belyaev (Legkie Metaly, 7, No. 1, 7-20 (1938)) a.o. $ZnFe_2O_4$, $NiFe_2O_4$.

Later examples from the first group are anodes based on $SnO_2$ doped with e.g. $Fe_2O_3$, $Sb_2O_3$ or $MnO_2$, documented in U.S. Pat. Nos. 4,233,148 (electrodes with up to 79 wt % $SnO_2$) and 3,718,550 (electrodes with more than 80 wt % $SnO_2$). Anode corrosion at low current densities has apparently been considered a problem, as several patents describe ways of protecting the anodes at low current densities by insulating ceramic rings or coatings to ensure that all exposed $SnO_2$ carries a reasonably high current. Sn impurities in the produced aluminium do, however, strongly impair the properties of the produced metal even at very low concentrations and so renders an anode based on $SnO_2$ unpractical.

Further, in EP0030834A3 doped spinels are described with a chemical composition based on the formula $M_{IX}M_{II3-x}O_4yM_{III}^{n+}O_{n/2}$ where $M_I$ is a divalent metal a.o. Ni, Mg, Cu or Zn, while $M_{II}$ is one or more divalent/trivalent metals from the group Ni, Co, Mn and Fe, and $M_{III}$ is one or more from a large group of tetra, tri, di and monovalent metals.

Other examples are the range of spinel and perovskite materials described in U.S. Pat. No. 4,039,401 and U.S. Pat. No. 4,173,518 of which, however, none have proved practical for use in an aluminium electrolysis cell. This is partly because of limited corrosion resistance and partly because of low electronic conductivity.

In U.S. Pat. No. 4,374,050 and U.S. Pat. No. 4,478,693 is disclosed a generic formula describing compositions of possible anode materials. The formula would cover practically all combinations of oxides, carbides, nitrides, sulfides and fluorides of virtually all elements of the periodic table. The examples concentrate on various stoichiometric and nonstoichiometric oxides of the spinel structure. None of these have proved practical, presumably because of limited stability towards dissolution and electronic conductivity. In U.S. Pat. No. 4,399,008 a material is described consisting of two oxide phases of which one is a compound of two oxides and the other a pure phase of one of the component oxides.

In the not yet published Norwegian patent application 20010928 (Norsk Hydro ASA) a class of materials is described, with the compositions $A_{1+x}(B_{1+\delta}C_d)O_4$ where A is a divalent cation or mixture of cations with a preference for octahedral coordination, preferably Ni, B is a trivalent cation or mixture of cations with a relative preference for tetrahedral coordination, preferably Fe, C is a trivalent cation or mixture of cations with a relative preference for octahedral coordination like Cr or a four-valent cation like Ti or Sn especially designed for high stability. O is the element oxygen. When C is trivalent $x=0$, $0<d<1$, $\delta<0.2$ and $x+d+\delta$ is essentially equal to 1. When C is four-valent $0.4<x<0.6$, $0.4<d<0.6$, $\delta<0.2$ and $x+d+\delta$ is essentially equal to 1. It is demonstrated that the material is more stable than other candidates.

As the electronic conductivity of the anode materials has been a problem, a number of efforts have been documented where the aim has been to combine an inert material with an interwoven matrix of an electronic conductor like a metallic phase. This is the second group mentioned above. Examples are: U.S. Pat. No. 4,098,669 where the ceramic phase is yttria, while the electronic conductor is either an oxide based on zirconium and/or tin or a metallic phase like yttrium, chromium, molybdenum, zirconium, tantalum, tungsten, cobalt, nickel, palladium or silver. In U.S. Pat. No. 4,146,438 the range of ceramic phases are expanded to include oxycompounds of most metals except the alkali and alkaline earth metals and in addition an electrocatalyst over at least a part of the electrode surface. In U.S. Pat. No. 4,397,729 a cermet anode with a ceramic phase consisting of one or more of nickel oxide, ferrite or hematite and a metal phase from a noble metal or an alloy of a noble metal with iron, cobolt, nickel or copper. In U.S. Pat. No. 4,374,761 the compositions of the aforementioned U.S. Pat. No. 4,374,050 are described as the ceramic part of a cermet with a metallic phase that can consist of a range of elements. An example from the extensive work carried out on the cermet anodes based on the spinel $NiFe_2O_4$ with a Cu or Ni based metal phase are U.S. Pat. No. 4,871,437 describing a production method for making electrodes with a dispersed metal phase. In U.S. Pat. No. 5,865,980 the metal phase is an alloy of copper and silver. The apparent problems with these materials is partly corrosion of the ceramic phase, and partly oxidation and subsequent dissolution of the metal phase under process conditions.

The third group is exemplified by a number of patents on alloys and alloy configurations. The advantage is the high electronic conductivity and the attractive mechanical properties, but common to all metals and metal alloys is, however, that none except the noble metals will be stable towards oxidation under working anode conditions. Different avenues to solve this problem have been followed. U.S. Pat. No. 5,069,771 discloses a method comprising the in-situ formation of a protecting layer made from a cerium oxyfluoride that is generated and maintained by the oxidation of cerium fluoride dissolved in the electrolyte. This technology was first described in U.S. Pat. No. 4,614,569, also for use with ceramic and cermet anodes, but in spite of extensive development work it has so far not found commercial applications. One problem is that the produced aluminium will contain cerium impurities, and thus requires an extra purification process step.

In U.S. Pat. No. 4,039,401 an anode consisting of a layer of more than 50% spinell or perovskite on a metal core is described. No specific system is described, however. The idea has an inherent problem linked to the difference in thermal expansion between the ceramic layer and the metallic core that has so far not been overcome.

In U.S. Pat. No. 4,620,905 a metal anode that will form a protective layer by in situ oxidation is described. Similarly, U.S. Pat. No. 5,284,562 describes alloy compositions based on copper, nickel and iron where the oxide formed creates a layer that is protective towards further oxidation. International applications WO 00/06800, WO 00/06802, WO 00/06804, WO 00/06805, U.S. Pat. No. 4,956,068, U.S. Pat. No. 4,956,068, U.S. Pat. No. 4,960,494, U.S. Pat. No. 4,999,097, U.S. Pat. No. 5,069,771 and U.S. Pat. No. 6,077,415 describe variations on very similar approaches. In U.S. Pat. No. 6,083,362 an anode is described where the protective layer is formed by the oxidation of aluminium on the surface of the anode, the layer being thin enough to still have acceptable electrical conductivity, and being replenished by the diffusion of aluminium through the metal anode from a reservoir in the anode.

Common to all these suggestions is, however, that none offer fully satisfactory solutions to the problem that metals or metal alloys except the noble metals will oxidize under working anode conditions. The formed oxide will gradually dissolve in the electrolyte, the rate depending on the oxide formed. In some cases this leads to buildup of oxide layers resulting in low electrical conductivity and high cell voltage, and in other cases spalling and excessive corrosion of the anode. In the ideal case the oxide is formed at the same rate as it is dissolved, the rate not being too high for a reasonable lifetime of the anode and not causing unacceptable concentrations of impurities in the produced metal. No such system has been demonstrated.

OBJECTS OF THIS INVENTION

The object of the present invention is to describe a principle of construction of an inert anode for the electrowinning of aluminium utilising the material class described in the NO 20010928 in a practical anode. The object of the invention is moreover to devise a principle of construction that can be implemented in a variety of anode shapes suiting processes with a variety of electrolysis cell geometries.

SUMMARY OF THE INVENTION

The invention is based on the material class given in NO 20010928, $A_{1+x}(B_{1+\delta}C_d)O_4$ where A is a divalent cation or mixture of cations with a preference for octahedral coordination, preferably Ni, B is a trivalent cation or mixture of cations with a relative preference for tetrahedral coordination, preferably Fe, C is a trivalent cation or mixture of cations with a relative preference for octahedral coordination like Cr or a four-valent cation like Ti or Sn especially designed for high stability. O is the element oxygen. When C is trivalent x=0, 0<d<1, δ<0.2 and x+d+δ is essentially equal to 1. When C is four-valent 0.4<x<0.6, 0.4<d<0.6, δ<0.2 and x+d+δ is essentially equal to 1. The material is chemically more inert under the conditions encountered under aluminium electrolysis than materials previously known in the art, but in common with most other oxide candidates the electronic conductivity is not sufficient to ensure that the resistive losses in the anode are acceptable. Moreover, in order to ensure an even distribution of current and to avoid spots of high current densities, a much higher electrical conductivity in the anode than in the electrolyte is required. In order to increase the electronic conductivity, the oxide material can be mixed with a material with high electronic conductivity, preferably a metal, forming a more or less interwoven matrix of a metal and a ceramic phase. The metallic phase will, however, be exposed to attack if subjected to the electrolyte. In order to retain the chemical inertness of the anode, according to the present invention the cermet core is covered with a dense layer of the ceramic material. The metal phase in the cermet must be stable towards reaction with the ceramic material, a criterion that limits the choice of possible metals to copper, silver and the noble metals or alloys of them. The anode can be produced by techniques like cold or hot isostatic pressing, uniaxial pressing, plastic moulding, gel casting, slip casting etc. with a subsequent process of co-sintering.

The ceramic layer must be thick enough to ensure a sufficient service life to make the use of an inert anode economical, and optionally the ceramic layer can be replenished by taking the anode out of the electrolysis cell and add a layer of the ceramic material to substitute what has been lost due to corrosion during service. This can be done by a deposition method like plasma spraying, flame spraying, CVD, PVD or other methods that can build a ceramic layer bonded to a ceramic substrate.

DETAILED DESCRIPTION OF THE INVENTION

In NO 20010928 a class of materials with the compositions $A_{1+x}(B_{1+\delta}C_d)O_4$ where A is a divalent cation or mixture of cations with a preference for octahedral coordination, preferably Ni, B is a trivalent cation or mixture of cations with a relative preference for tetrahedral coordination, preferably Fe, C is a trivalent cation or mixture of cations with a relative preference for octahedral coordination like Cr or a four-valent cation like Ti or Sn especially designed for high stability is described. O is the element oxygen. When C is trivalent x=0, 0<d<1, δ<0.2 and x+d+6 is essentially equal to 1. When C is four-valent 0.4<x<0.6, 0.4<d<0.6, δ<0.2 and x+d+δ is essentially equal to 1. It is demonstrated that the material is more stable than other candidates. The material has an electrical conductivity in the range 1-2 S/cm, which is in the same order as the electrolyte used during aluminium electrolysis. This electrical conductivity is sufficient for use as an active anode layer, but not sufficient to ensure an optimal current distribution and low electrical losses if the anode as a whole is constructed from this material.

The essence of the present invention is to improve this situation by providing a low resistance path for the current to the whole working surface of the anode. This is done by having the anode material as a dense layer on an anode body made from a material compatible chemically and thermally with the ceramic anode material. To ensure this compatibility this material should to a large extent consist of the same ceramic phase as the dense outer layer, but with sufficient additions of a material with high electronic conductivity to give an acceptable conductivity at the temperature in question. This temperature is determined partly by the temperature of the electrolysis process (680-1000° C.), but also by the design of the connection of the anode to the current leads. To ensure maximum flexibility in design of the electrolysis process, the core should have metallic conductivity.

A core with high electronic conductivity can be achieved by mixing the material of the working anode surface with a metallic phase as illustrated in examples 1 and 2. Considering the stability of the oxides in question, it is clear that if the anode material contains three-valent iron, it is only copper, silver, the noble metals and alloys of the metals mentioned that will be compatible. Nickel, which would be the metal closest in stability to the aforementioned metals, would react with the anode material forming a mixed phase of NiO and FeO and several other reaction products. If the main component of the metallic phase is copper, a slight addition of the order of a few wt % of Ni and even less Fe could still be advantageous to prevent an exchange reaction between the metallic and ceramic phase. The analysis of the ceramic and metal phase reported in example 4 supports this suggestion.

The present invention will have embodiments for anodes in electrolysis cells constructed for vertical, horizontal and tilted anode surfaces.

One possible embodiment would be in a plate-shaped anode with near vertical electrolysis surfaces, where the core with high electronic conductivity is connected to electrical leads through extensions above the electrolyte, while everywhere except at the connections being protected by a dense layer of the anode material. The dimensions of the core with high electronic conductivity are sufficient to ensure low energy loss and current distribution, while the thickness of the dense ceramic layer is sufficient to ensure a sufficient life time of the anode taking into account a steady-state corrosion rate.

In another embodiment the anode is shaped as a bowl or cup with a dense ceramic layer forming the outer surface with an inner core of the composite material with high electronic conductivity, optionally covered with the dense ceramic material as a protection against oxidation and other chemical attacks. The electric connection can be made by having the core with dense ceramic covering extending out of the cup or bowl, or by welding a connection directly to the core in the cup or bowl. The dimensions of the core must be sufficient to ensure even current distribution and low energy losses, and the dimensions of the dense ceramic layer must be sufficient to ensure an economically viable lifetime.

A possibility would be to make the anodes from segments, each segment being a core/dense surface unit, that together make up the full geometry of the anode with the electrical connections made to the cores.

Electrical connections can be made to the cores by brazing, welding, screwing etc.

Such anodes can be produced to green shape by known ceramic techniques like a.o. pressing, uniaxially or isostatically, plastic moulding, gel casting, slip casting, followed by steps like binder burnout and cosintering. The shaping process will most often entail two steps with first shaping the core, and afterwards shaping the ceramic surface around it. If a metal phase is used as part of the core; most relevant copper; it is important to control the oxygen content of the sintering atmosphere to avoid oxidation.

An option to prolong the lifetime of the anode would be the following: After a predetermined service time remove the anode from the electrolysis cell, then clean it by sand blasting or another effective method for removal of deposits, and finally have the dense outer layer replenished by plasma spraying, flame spraying, CVD, PVD or such methods that can built a ceramic layer bonded to a ceramic substrate. It is not critical that this layer is fully dense.

Figure 2:
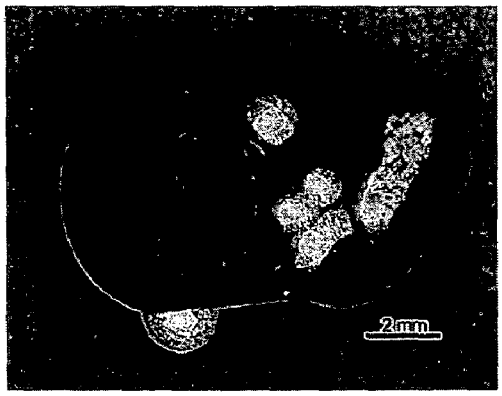
Figure 3:
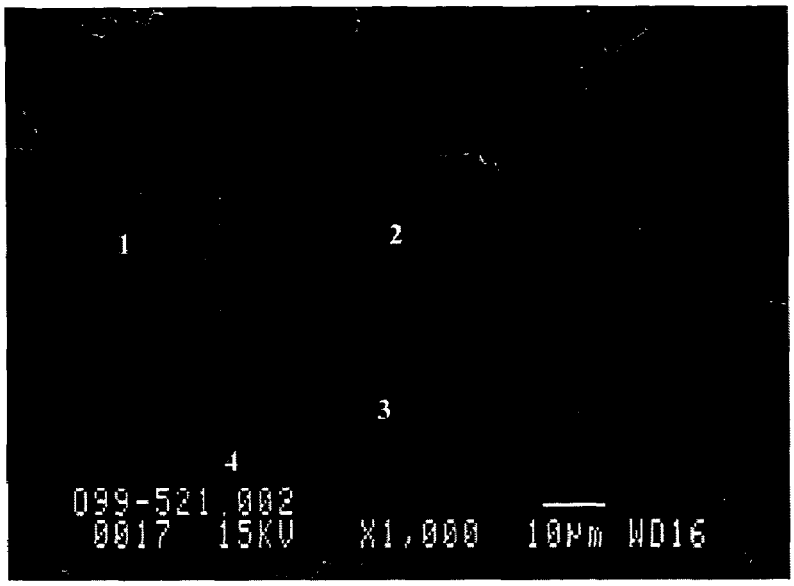
Figure 4:
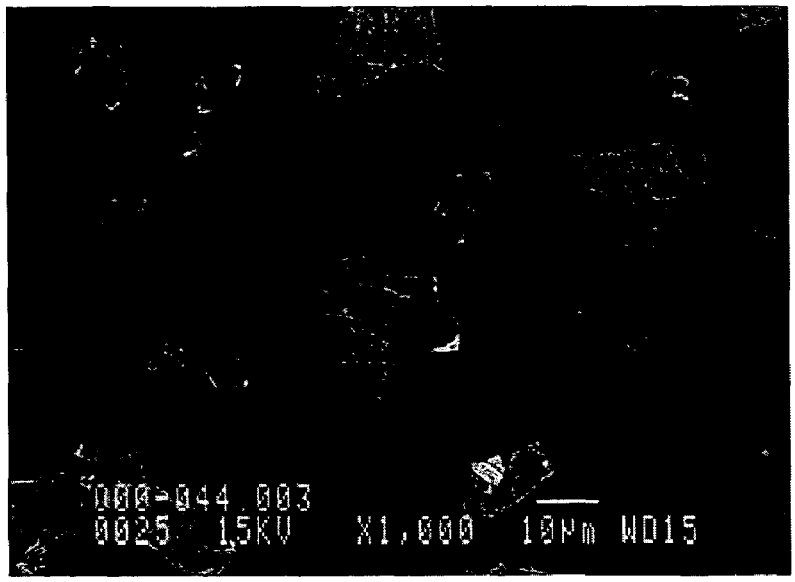
Figure 5:
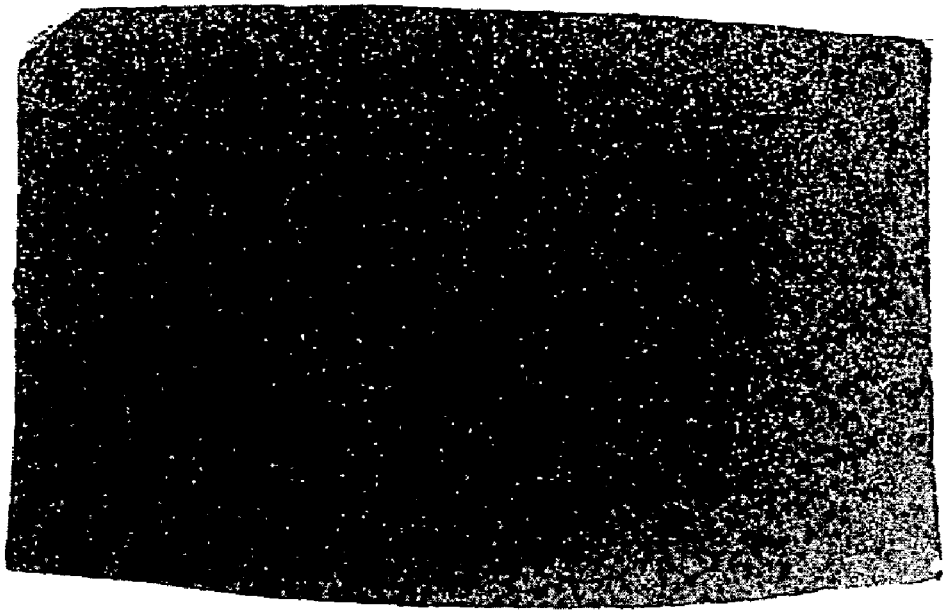

The invention is further illustrated and supported by the following examples and figures where:

FIG. 1 shows a sample with inner core of cermet and an approximately 1 mm outer layer of ceramic, FIG. 2: light microscope photograph of a cermet sample of $Ni_{1.53}FeTi_{0.47}O_4$ with 20 wt % Cu sintered in $N_2$ atmosphere at 1375° C. for 0.5 hours, FIG. 3: SEM back scatter photograph of a polished sample of $Ni_{1.53}FeTi_{0.47}O_4$ with 14 wt % CuAg alloy in the inner core, FIG. 4: SEM back scatter photograph of a polished sample of $Ni_{1.53}FeTi_{0.47}O_4$ with 20 wt % metal alloy where the alloy consist of 95 wt % Cu and 5 wt % Ag, FIG. 5 shows a photograph of a cross-sectional area of a polished sample of $Ni_{1.53}FeTi_{0.47}O_4$ with 20 wt % CuAg alloy, FIG. 6: is a photograph of a working anode before an electrolysis experiment, FIG. 7: shows a photograph of the working anode of FIG. 6 after the electrolysis experiment, FIG. 8: illustrates the cross section of an anode end towards the cathode, FIG. 9: shows an overview over the cross section of the immersed anode, FIG. 10: back scatter SEM photograph of a cut and polished cross section of an anode, which was immersed in the electrolyte.

Figure 11:
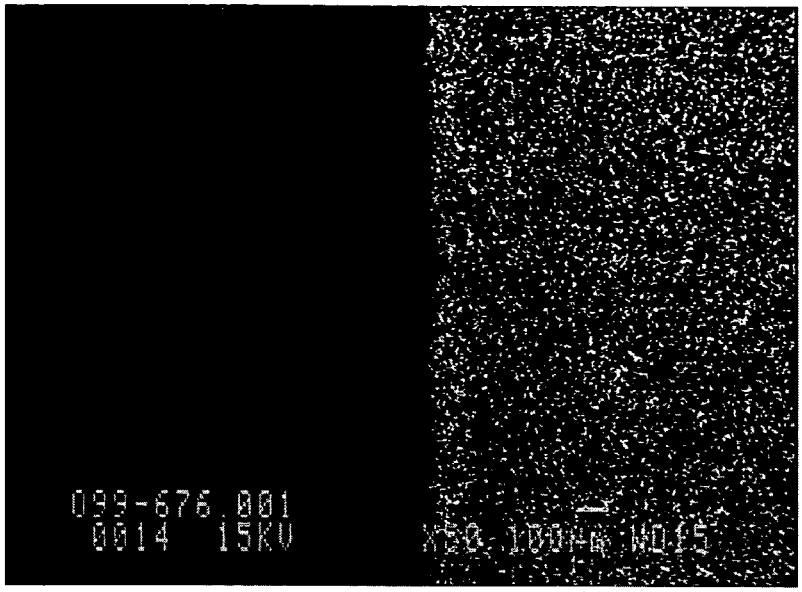

FIG. 11: back scatter SEM photograph of a cut and polished cross section of the anode which was above the electrolyte.

Figure 12:
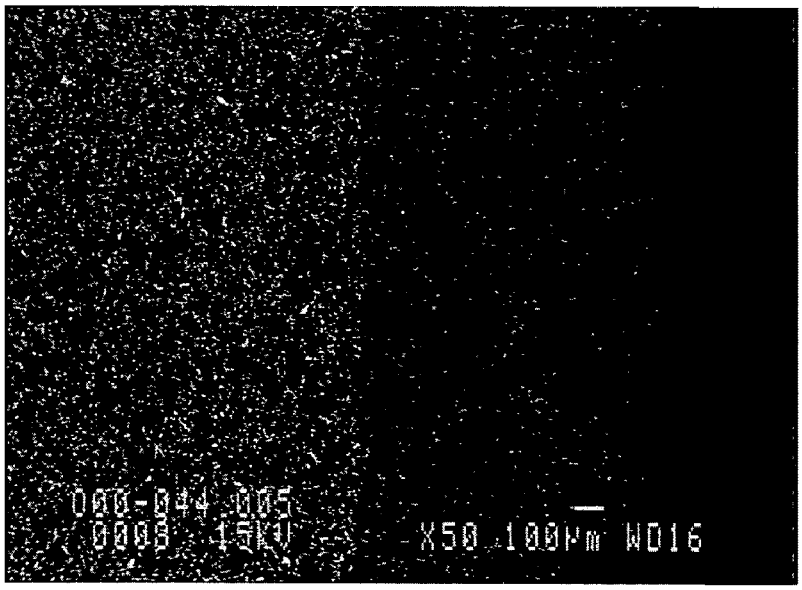

FIG. 12: back scatter SEM photograph of a cut and polished cross section of an area of an anode, which has been immersed in electrolyte.

EXAMPLE 1

Electronic Conductivity of Anode Cermet Materials with Different Contents of Metal The total electrical conductivity was measured in air by a 4-point van der Pauw dc-measurements method (ref.: van der Pauw, L. J., Phillips Res. Repts. 13 (1), 1958; and Poulsen, F. N., Buitink, P. and Malmgren-Hansen, B.—Second International Symposium on solid oxide fuel cells, Jul. 2-5, 1995—Athens.). The samples, cermets of $Ni_{1.5+x}FeTi_{0.5-x}O_4$ where $0<x<3$ and different amount of metal, were discs with diameter of approximately 25 mm and thickness of less than 2.5 mm. Four contacts were made to the circumference of the sample with a droplet of platinum paste. For samples with the higher silver content, a 2-point dc-measurements method was used. In this case the contacts were made to the end of a rod with droplets of silver paste. The materials with 30, 40 and 50 wt % Ag are sintered with a dense outer layer. Before connecting the electrodes to the sample the dense layer was cut off where the connections were to be made.

The results at 600° C. and 900° C. are reported in the table below. For samples with 20 wt % metal or lower, the measured conductivity fluctuated somewhat from sample to sample.

| Metal content in the sample: | Electrical conductivity at 600° C.: | Electrical conductivity at 900° C.: |
|---|---|---|
| 10 wt % Cu | 3 S/cm | 7 S/cm |
| 20 wt % 95Cu5Ag | 7 S/cm | 14 S/cm |
| 15 wt % Ag | 7 S/cm | 10 S/cm |
| 20 wt % Ag | up to 300 S/cm | up to 200 S/cm |
| 30 wt % Ag | 570 S/cm | 400 S/cm |
| 40 wt % Ag | 1940 S/cm | 1300 S/cm |
| 50 wt % Ag | metallic, not measurable with the methods used here | |

The conclusion of the experiment is that percolation or a interwoven matrix of metal in the ceramic phase appears above 30 wt % Ag, which correspond to about 17 vol % Ag.

EXAMPLE 2

Synthesis of Cermet Materials of $Ni_{1.5+x}FeTi_{0.5+x}O_4$ with Ag and Dense Outer Layer The powder was prepared by means of a soft chemistry route. For the synthesis the appropriate $Ni(NO_3)_3$, $Fe(NO_3)_3$ and $TiO_5H_{14}C_{10}$ were mixed and spray pyrolysed. The calcination was normally performed at 900° C. for 10 hours. Ag (Alfa, silver powder, APS 0.7-1.3 μm, 99.9% Ag, Johnson Matthey) were mechanically mixed into the ceramic powder in the amount of 10, 15, 20, 25, 30, 40 and 50 wt % Ag. The samples were either uniaxially pressed at approximately 100 MPa or they were cold isostatically pressed at 200 MPa. The sintering temperature was in the range 1200° C.-1500° C., normally 1400° C. to 1450° C. and a holding time for 3 hours. During the sintering process some Ag were squeezed out as droplets even if the Ag metal wetted the ceramic well. During the sintering process some Ag metal evaporated from the surface so that the outer approximately 10 μm of cermet material became metal free. An outer layer of ceramic prevented the loss of Ag metal. Practically this was done by first pressing a green body of cermet, packing ceramic powder around this body and then a second pressing at a higher pressure.

FIG. 1 shows a sample with inner core of cermet and an approximately 1 mm outer layer of ceramic.

FIG. 1: SEM (Scanning Electron Microscope) back scatter photograph of a polished sample of $Ni_{1.53}FeTi_{0.47}O_4$ with 20 wt % Ag in the inner core sintered in air at 1400° C. for 3 hours. Ag can be seen as light particles in the lower right quarter of the picture. Magnification 30×.

EXAMPLE 3

Synthesis of a Cermet Material of $Ni_{1.5+x}FeTi_{0.5-x}O_4$ with Cu

The synthesis and calcination of the ceramic powder were done in the same way as described in example 2. Cu powder (Dendritic Cu powder, 99.9 wt %, 1-5 μm, Novamet) were mechanically mixed into the ceramic powder. The sample was uniaxially pressed at approximately 100 mPa. The sintering temperature was 1375° C. for 0.5 hours in $N_2$ atmosphere. The Cu metal did not wet the ceramic phase well. Cu metal was squeezed out during the sintering process, especially in the direction of gravitational pull, even though the cermet was covered with a metal free ceramic layer.

FIG. 2 shows a photograph of a cermet sample of $Ni_{1.53}FeTi_{0.47}O_4$ with 20 wt % Cu after sintering.

FIG. 2: Light microscope photograph of a cermet sample of $Ni_{1.53}FeTi_{0.47}O_4$ with 20 wt % Cu sintered in $N_2$ atmosphere at 1375° C. for 0.5 hours.

EXAMPLE 4

Synthesis of a Cermet Material of $Ni_{1.5+x}FeTi_{0.5-x}O_4$ with Ag and Cu and Dense Outer Layer The synthesis and calcination of the ceramic powder were done in the same way as described in example 2. Ag and Cu powder, the same powder as in example 2 and 3, were mechanically mixed with the synthesised ceramic powder and pressed to green bodies as reported in example 2. Sintering was done in an inert atmosphere, $N_2$ or Ar, at a sintering temperature in the range 1200° C. to 1500° C. Due to problems with oxidizing of Cu metal in air at low temperature the debinding had to be performed in an inert atmosphere. Previous experiments showed that the Cu metal did not wet the ceramic, even if the cermet was covered with a layer of metalfree ceramic phase. When Ag was added a significant change in the wetting behaviour occurred.

FIG. 3: SEM back scatter photograph of a polished sample of $Ni_{1.53}FeTi_{0.47}O_4$ with 14 wt % CuAg alloy in the inner core. The CuAg alloy contains 67 wt % Cu and 33 wt % Ag. The sample was sintered for 1 hour in $N_2$ atmosphere at 1435° C. EDS analysis shows area 1 to contain mainly Cu, area 2 mainly Ag, area 3 NiO with about 5 at % Fe and area 4 the Ni, Fe, Ti and O spinel structure. Magnification 1000×.

A smaller amount of Ag in the metal alloy gives the same good wetting behaviour. FIG. 4 shows an example with 5 wt % Ag in the Cu alloy.

FIG. 4: SEM back scatter photograph of a polished sample of $Ni_{1.53}FeTi_{0.47}O_4$ with 20 wt % metal alloy where the alloy consist of 95 wt % Cu and 5 wt % Ag. The sample was sintered for 3 hours in $N_2$ atmosphere at 1400° C. Notice small spots of Ag (appearing as white spots) in the boundary between the ceramic and the alloy (light grey area). Magnification 1000×.

Typical EDS spot analyses of some phases are reported in the table below. The effect of contaminating the surface during preparation, by polishing with diamond down to 1 μm, can be seen as Ti is detected both in Cu, Ag and NiO phase.

Typical EDS spot analysis, atom %, of some phases shown in the SEM photograph in FIG. 4:

| Element: | Ceramic phase: | Cu metal phase: | Ag metal phase: | NiO grains: |
|---|---|---|---|---|
| O | 57.7 | 1.9 | 1.9 | 50.9 |
| Ti | 8.7 | 0.2 | 0.7 | 0.4 |
| Fe | 15.6 | 1.4 | 1.4 | 4.7 |
| Ni | 17.6 | 4.4 | 2.3 | 44.0 |
| Ag | 0.0 | 1.9 | 82.8 | 0.0 |
| Cu | 0.4 | 90.2 | 10.9 | 0.0 |

The analysis result shows that some Cu is detected in the ceramic phase and Ni is detected in the Cu metal phase.

FIG. 5 shows a photograph of a cross-sectional area of a polished sample of $Ni_{1.53}FeTi_{0.47}O_4$ with 20 wt % CuAg alloy. The Ag content in the Cu alloy is 5 wt %.

FIG. 5: Photograph of a cross section of a polished sample of $Ni_{1.53}FeTi_{0.47}O_4$ with 20 wt % CuAg alloy. The Ag content in the Cu alloy is 5 wt %. The length of the whole sample is 18 mm and the width is 12 mm. The interior of the sample which is some darker in color, is the cermet phase.

EXAMPLE 5

Figure 6:
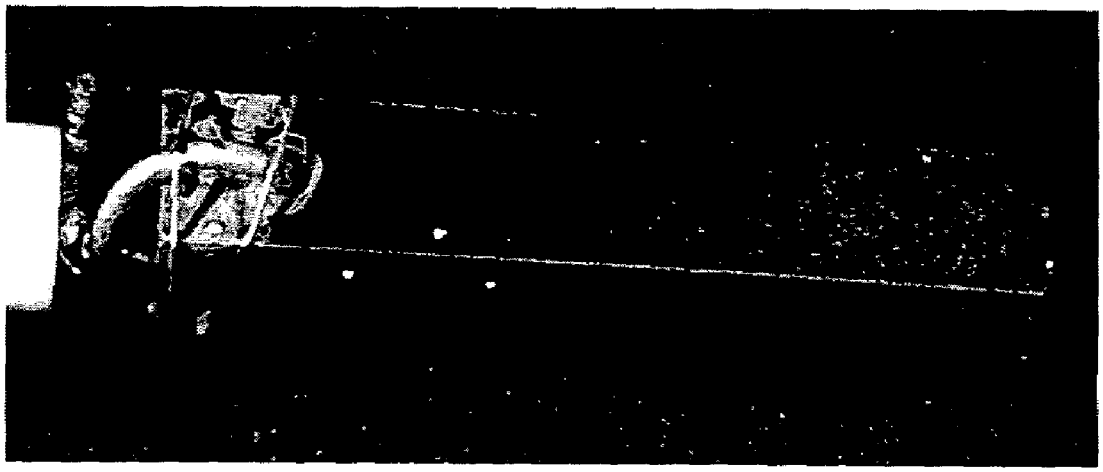
Figure 7:
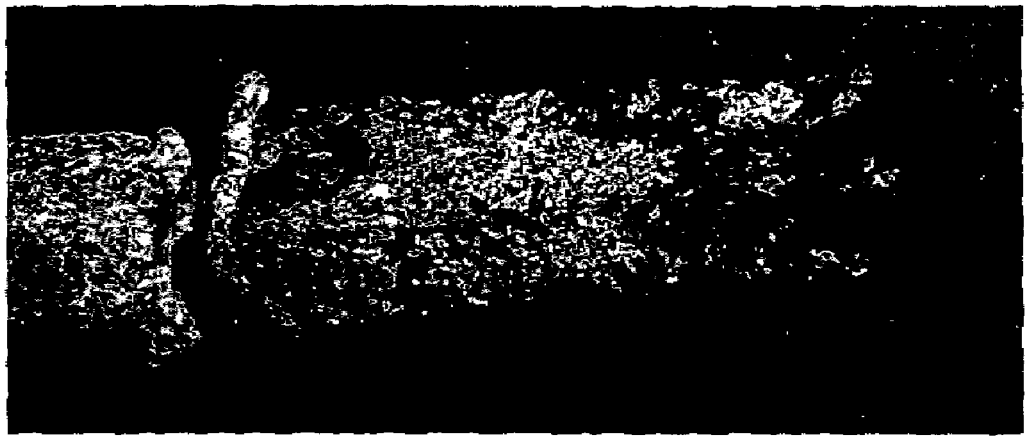

Electrolytic Production of Aluminium with Cermet of $Ni_{1.53}FeTi_{0.47}O_4$ with 15 wt % Ag as Anode Material The electrolysis cell was made up of an alumina crucible with inner diameter 80 mm and height 150 mm. An outer alumina container with height 200 mm was used for safety. A lid made from high alumina cement was placed on the top. In the bottom of the crucible a 5 mm thick $TiB_2$ disc was placed, which made the liquid aluminium cathode surface stay horizontal because of good wettability to the $TiB_2$. Thereby a well-defined cathode surface area was obtained. The electrical connection to the cathode was provided by a $TiB_2$ rod supported by an alumina tube to avoid oxidation. Platinum wires gave good electrical connection to the working anode and to the $TiB_2$ cathode rod. The platinum wire to the anode was protected by a 5 mmØ alumina tube. Photographs of the working anode before and after electrolysis are shown in FIGS. 6 and 7.

The anode was made from $Ni_{1.53}FeTi_{0.47}O_4$ powder synthesised as described in example 2 and mixed with 15 wt % Ag powder from Alfa, 0.7-1.3 μm, 99.9%. The powder mixture was added 2 wt % polyacrylic binder, pressed uniaxially to rods at a pressure of approximately 300 MPa and then sintered in air for 3 hours in the range 1450° C. to 1500° C. Very few and small Ag droplets were squeezed out of the sample during the sintering process. This can be seen on the photo of the anode before the electrolysis experiment in FIG. 6.

The electrolyte was made from a mixture of:

532 g $Na_3AlF_6$ (Greenland cryolite)

105 g $AlF_3$ (from Norzink, with about 10% $Al_2O_3$)

35 g $Al_2O_3$ (annealed at 1200° C. for some hours)

21 g $CaF_2$ (Fluka p.a.)

In the bottom of the alumina crucible was placed 340 g Al, 99.9% pure from Hydro Aluminium a.s.

The anode was hanging under the lid while the salts were melting. When the electrolysis experiment started, the anode was dipped 1 cm into the electrolyte. The temperature of the experiment was 970° C., which is higher than the melting temperature for Ag, and it was kept constant during the whole experiment. The electrolysis current density was set to 1000 $mA/cm^2$ based on the end cross-sectional area of the anode. The real current density was somewhat lower because the side surfaces of the anode were also immersed in the electrolyte.

The electrolysis experiment lasted for 26 hours. The cell voltage was constant, 5.1 V, during the whole experiment. After the experiment the anode was cut, polished and examined in SEM. The outer approximately 100 μm thick layer of the cermet, which had been immersed in the electrolyte, was free from Ag. No reaction layer at the outer surface could be seen.

FIG. 6: Photograph of the working anode before the electrolysis experiment. Some platinum paste was used to provide good electrical contact between the anode and the platinum wire. Note the small droplets of Ag that have been squeezed out during the sintering process at 1450° C. for 3 hours. The dimension of the anode was 6.0 mm×3.9 mm×27.8 mm.

FIG. 7: Photograph of the working anode after the electrolysis experiment. One third of the anode has been immersed in the electrolyte.

Figure 8:
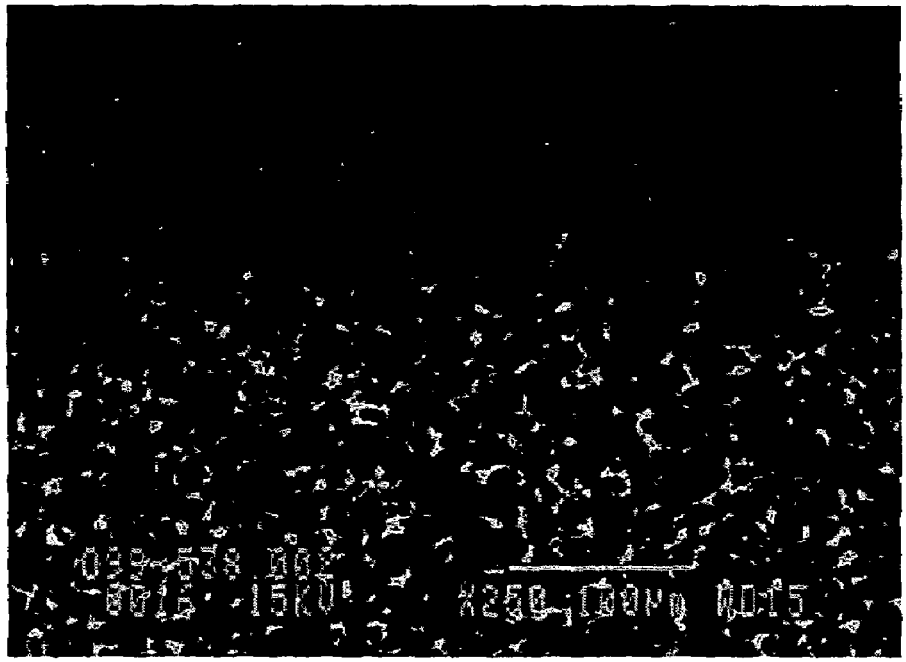
Figure 9:
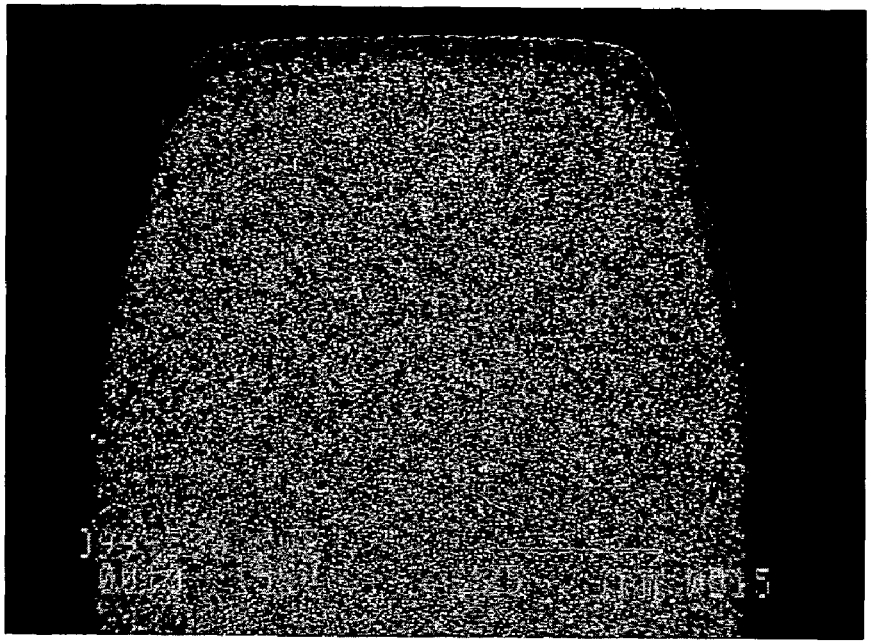

FIG. 8 illustrates the cross section of the anode end towards the cathode, and FIG. 9 shows the overview over the cross section of the immersed anode.

FIG. 8: Back scatter SEM photograph from the cross section of the anode towards the cathode. The outer layer of approximately 100 μm cermet is free from metal. Ag metal appears as white spots or areas. Magnification 250×.

FIG. 9: Back scatter SEM photograph of the cut and polished cross section of the anode, which was immersed in electrolyte. Ag particles appear as white spots. Note the outer metal-free layer of the cermet. The end shown at the top on the picture was pointing downwards towards the cathode during the experiment. Magnification 25×.

Another experiment with the same type of anode material was performed in the same manner as described above, but at a lower temperature. The electrolyte composition was changed in order to have a lower liquidus temperature. The composition of the electrolyte this time was:

525 g $Na_3AlF_6$ (synthetic, with about 1.1 wt % excess NaF)

135 g $AlF_3$ (from Norzink, with about 10% $Al_2O_3$)

32 g $Al_2O_3$ (annealed at 1200° C. for some hours))

22 g $CaF_2$ (Fluka p.a.)

Figure 10:
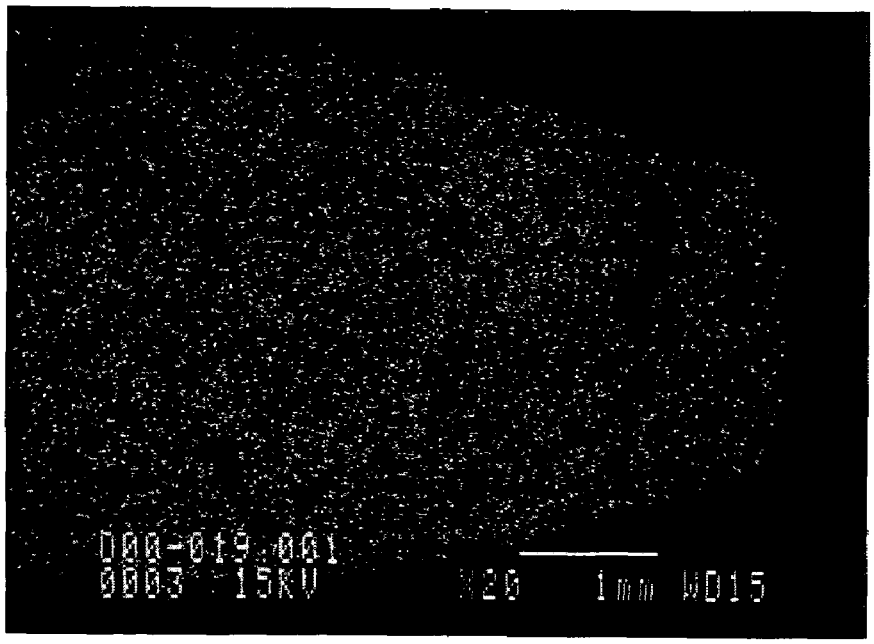

The operating temperature of 940° C. was kept constant during the whole experiment. The experiment lasted for 50 hours. FIG. 10 shows a photo of the cross section of the anode after this experiment. Also in this case the outer approximately 100 μm of the cermet was free from Ag metal.

FIG. 10: Back scatter SEM photograph of the cut and polished cross section of the anode, which was immersed in the electrolyte. The temperature of the experiment was 940° C. Ag particles appear as white spots. Note the outer metal-free layer of the cermet. The end to the right on the picture was pointing downwards to the cathode.

In both the electrolysis experiments the metal phase was evenly distributed in the interior of the anode material, which was immersed in the electrolyte, both when the temperature was above and below the melting temperature for Ag. The outer approximately 100 μm of the anode material that was immersed in the electrolyte was free from metal.

The conclusion of the experiment is loss of Ag from the anode. The experiment illustrate that Ag is lost from a cermet not protected by a dense outer layer.

EXAMPLE 6

Anode with Dense Layer Before and after Testing in Electrolysis Cell

This example illustrates an anode with a dense outer layer of $Ni_{1.53}FeTi_{0.47}O_4$ and an inner core of $Ni_{1.53}FeTi_{0.47}O_4$ with 20 wt % Ag after testing in the electrolysis cell. The electrolysis experiment lasted for 72 hours. The electrolyte had a cryolite ratio (CR) of 2.1 (or 15 wt % $AlF_3$ in excess of the cryolite composition), 5 wt % $CaF_2$ and 6 wt % $Al_2O_3$. The temperature was about 940° C. The cell voltage remained constant during the last 64 hours of the test.

FIG. 11 shows a photograph of the polished cross-sectional area of an anode after experiment, but the part that was kept above the electrolyte. FIG. 10 can be compared to FIG. 1, which shows a polished cross section of a same type of anode material after sintering, but before the electrolysis experiment. FIG. 12 shows an area of the anode, which has been immersed in the electrolyte during the electrolysis experiment.

FIG. 11: Back scatter SEM photograph of the cut and polished cross section of the anode which was above the electrolyte. The temperature of the experiment was 940° C. Ag particles appear as white spots.

FIG. 12: Back scatter SEM photograph of the cut and polished cross section of an area of the anode, which has been immersed in electrolyte. Ag particles appear as white spots.

As can be seen from FIG. 12 some Ag metal has migrated into the dense layer because the outer layer was not fully dense. The cermet core appears, however, not affected.

The invention claimed is:

1. An anode for the electrolysis of aluminum having an outer layer of a ceramic material and a core of a composite material, where said composite material comprises an electronic conducting material and a ceramic material arranged in a continuous network, wherein the ceramic material in the composite is of the same type as that of the outer layer, wherein the ceramic material has the composition $A_{1+x}(B_{1+\delta}C_d)O_4$, where A is a divalent cation or mixture of cations, B is a trivalent cation or a mixture of cations, and C is a trivalent cation or mixture of cations or tetravalent cation, O is the element oxygen, for C trivalent; $x=0$, $0<d<1$, $\delta<0.2$ and $x+d+\delta$ is essentially equal to 1, for C tetravalent; $0.4<x<0.6$, $0.4<d<0.6$, $\delta<0.2$ and $x+d+\delta$ is essentially equal to 1, and that the electronic conducting material comprises Ag optionally alloyed or mixed with other conducting materials.

2. The anode in accordance with claim 1, wherein the metal content of the composite material in the core is between 15 and 60 vol %.

3. The anode of claim 1, wherein the electronic conducting material comprises an alloy of Cu and Ag.

4. The anode of claim 1, wherein the alloy further comprises between 0 and 5 wt % Ni and between 0 and 1 wt % Fe.

5. The anode of claim 1 where the cation of A has octahedral coordination, the cation of B has tetrahedral coordination and the cation of C when trivalent has octahedral coordination.

6. The anode of claim 5 where A is Ni, B is Fe and C when trivalent is Cr or when tetravalent is Ti or Sn.

7. An assembly comprising the anode of claim 1, wherein the electrical connections in the anode are made by brazing, welding or screwing electrical leads to the composite core material.

* * * * *